US007116899B2

(12) United States Patent
Franke et al.

(10) Patent No.: US 7,116,899 B2
(45) Date of Patent: Oct. 3, 2006

(54) OPERATING METHOD FOR A HORIZONTAL STEAM GENERATOR AND A STEAM GENERATOR FOR CARRYING OUT SAID METHOD

(75) Inventors: Joachim Franke, Altdorf (DE); Rudolf Kral, Stulin (DE); Eberhard Wittchow, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/527,278

(22) PCT Filed: Aug. 28, 2003

(86) PCT No.: PCT/EP03/09569

§ 371 (c)(1),
(2), (4) Date: Mar. 8, 2005

(87) PCT Pub. No.: WO2004/025176

PCT Pub. Date: Mar. 25, 2004

(65) Prior Publication Data

US 2006/0081359 A1 Apr. 20, 2006

(30) Foreign Application Priority Data

Sep. 10, 2002 (EP) ..... 02020251

(51) Int. Cl.
*F22B 29/06* (2006.01)

(52) U.S. Cl. ..... 392/396; 392/397; 392/398

(58) Field of Classification Search ..... None
See application file for complete search history.

(56) References Cited

U.S. PATENT DOCUMENTS 6,019,070 A 2/2000 Duffy

FOREIGN PATENT DOCUMENTS

| | | | |
|---|---|---|---|
| DE | 34 41 972 | A1 | 5/1986 |
| DE | 197 00 350 | A1 | 7/1998 |
| EP | 0 450 072 | A1 | 10/1991 |
| EP | 0 944 801 | B1 | 9/1999 |
| JP | 03 221702 | A | 9/1991 |

OTHER PUBLICATIONS

Von R. Kral, Susanne Schröder, Th. Zipfel, "Versuche mit einem senkrecht berohrten Benson®—Verdampfer in einem 160-t/h-Dampferzeuger", VGB Kraftwerkstechnik, Sep. 1993, pp. 793-797, No. 9, Germany.

Von H. Juzi, A. Salem, W. Stocker, "Zwangdurchlaufkessel für Gleitdruckbetrieb mit vertikaler Brennkammerberohrung", VGB Kraftwerkstechnik 64, Apr. 1984, pp. 292-302, No. 4, Germany.

*Primary Examiner*—Thor S. Campbell

(57) ABSTRACT

The invention relates to a steam generator in which the continuous heating panel of an evaporator is arranged in a heating gas channel which can be cross-flown in a more or less horizontal direction of a heating gas. Said continuous heating panel of the evaporator comprises a plurality of pipes of a steam generator which are connected in parallel to each other. Said pipes are constructed in such a way that they cross a flow medium and are provided with the part of a more or less vertical down pipe which can be cross-flown by the flow medium in a downward direction and with the part of a rising pipe connected downstream with respect to the down pipe on the side of the flow medium and which is more or less vertical and can be cross-flown by the flow medium in an upward direction. The continuous heating panel of the evaporator is arranged in such a way that one pipe of the steam generator which is hotter than the other pipe of the steam generator of the same continuous heating panel of the evaporator has a flow medium rate which is higher than that of the other pipe of the steam generator. The aim of said invention is to operate said steam generator in a relatively simple manner in association with a highly stable flow in the continuous heating panel of the evaporator. For this purpose, the flow medium of the continuous heating panel of the evaporator is supplied in such a way that the flow velocity thereof is higher than a minimum flow velocity predefined in the down pipe. The inventive steam generator is extremely well adapted for carrying out said method and comprises another continuous heating panel of the evaporator which is connected downstream with respect to the continuous heating panel of the evaporator on the side of the flow medium.

12 Claims, 5 Drawing Sheets

OPERATING METHOD FOR A HORIZONTAL STEAM GENERATOR AND A STEAM GENERATOR FOR CARRYING OUT SAID METHOD

CROSS REFERENCE TO RELATED APPLICATION

This application is the U.S. National Stage of International Application No. PCT/EP2003/009569, filed Aug. 28, 2003 and claims the benefit thereof. The International Application claims the benefits of European Patent application No. 02020251.1 EP filed Sep. 10, 2002, both of the applications are incorporated by reference herein in their entirety.

FIELD OF THE INVENTION

The invention relates to a method for operating a steam generator in which the continuous heating panel of an evaporator is arranged in a heating gas channel which can be cross-flown in a more or less horizontal direction of a heating gas. Said continuous heating panel of the evaporator comprises a plurality of pipes of a steam generator which are connected in parallel to each other. Said pipes are constructed in such a way that they cross a flow medium and are provided with the part of a more or less vertical down pipe which can be cross-flown by the flow medium in a downward direction and with the part of a riser pipe connected downstream with respect to the down pipe on the flow medium side and which is more or less vertical and can be cross-flown by the flow medium in an upward direction in which case the continuous heating panel of the evaporator is arranged in such a way that one pipe of the steam generator which is hotter than the other pipe of the steam generator of the same continuous heating panel of the evaporator has a flow medium rate which is higher than that of the other pipe of the steam generator. It also relates to a steam generator for carrying out said method.

BACKGROUND OF THE INVENTION

In the case of a gas and steam turbine plant, the heat obtained from the operating means or the heating gas from the gas turbine is used to generate steam for the steam turbine. Heat is transferred to a waste-heat steam generator connected downstream of one of the gas turbines in which a plurality of heating panels are usually arranged to preheat the water in order to generate and superheat the steam. The heating panels are connected to the water-steam cycle of the steam turbine. The water-steam cycle usually includes a number of pressure stages, for example three, in which case, each pressure stage can feature an evaporator heating panel.

For the steam generator connected downstream on the heating gas side of the gas turbine as a waste-heat steam generator, several alternative embodiment concepts can be taken into consideration, namely, the embodiment as a continuous steam generator or the embodiment as a circulation steam generator. In the case of a continuous steam generator, when the steam generator pipes provided as evaporator pipes are heated, the flow medium in the steam generator pipes evaporates in a single through-flow. However, by contrast with this, in the case of a natural or forced circulation steam generator, the circulating water is only partially evaporated when flowing through the evaporator pipes. The water not evaporated in this case is again supplied to the same evaporator pipes for further evaporation after the generated steam has been separated.

Unlike a natural or forced circulation steam generator, the continuous steam generator is not subjected to a pressure limit so that in the case of initial steam pressures it can be embodied to exceed the critical pressure of water by far ($P_{Kri}$≈221 bar), in which case, it is not possible to differentiate between the water phase and the steam phase and, as a result, a phase separation is also not possible. A high initial steam pressure favors a high thermal degree of effectiveness and, therefore, low $CO_2$ emissions of a fossil-heated power plant. In addition, a continuous steam generator compared to a circulation steam generator has a simple embodiment and can, as a result, be manufactured particularly cost-effectively. Therefore, the application of a steam generator embodied according to the through-flow principle as a waste-heat steam generator of a gas and steam turbine plant is, in this case, particularly favorable for obtaining a high overall degree of effectiveness of the gas and steam turbine plant with a simple embodiment.

Particular advantages with respect to manufacturing costs, but also with respect to maintenance work are offered by the horizontal waste-heat steam generator, for which the heating medium or the heating gas, that is the waste gas from the gas turbine is cross-flown in a more or less horizontal direction of flow through the steam generator. However, in the case of a horizontal steam generator, the steam generator pipes of a heating panel of the evaporator can, depending on their positioning, be exposed to greatly varying heating temperatures. Particularly in the case of the steam generator pipes of a continuous steam generator connected on the outlet side to a common accumulator, a different heating of the individual steam generator pipes, in each case, can lead to a joining together of the steam flows with the steam parameters deviating strongly from one another and, as a result, to undesirable losses in the efficiency, particularly to a relatively drop in efficiency of the heating panel involved and resulting reduced steam generation. A difference in heating of neighboring steam generator pipes can, in addition, damage the steam generator pipes or the accumulator particularly in the joining area of the accumulators in each case. Thus the desirable application of a horizontal continuous steam generator, in itself, embodied as a waste-heat steam generator for a gas turbine may cause considerable problems with respect to a sufficiently stabilized flow control.

From EP 0 944 801 B1, a steam generator designed for horizontal use is known and it also has the above-mentioned advantages of a continuous steam generator. In addition to this, the heating panel of the evaporator of the known steam generator is arranged as a continuous heating panel and is embodied in such a way that one pipe of the steam generator which is hotter than the other pipe of the steam generator of the same continuous heating panel of the evaporator has a flow medium rate which is higher than that of the other pipe of the steam generator. Thus, the continuous heating panel generally means a heating panel which is embodied for a cross-flow according to the through-flow principle. The flow medium supplied to the heating panel of the evaporator arranged as the continuous heating panel, therefore, completely evaporates in a single through-flow in each case through this continuous heating panel or through a heating panel system comprising a plurality of continuous heating panels which are connected in series to each other.

The evaporator panel of the evaporator of the known steam generator arranged as a continuous heating panel therefore shows, in the nature of the flow characteristics of a heating panel of a natural circulation evaporator (natural circulation characteristics) in the case of a different heating of the individual pipes of a steam generator, a self-stabilizing behavior, which without the requirement of external influences adjusts the temperatures on the outlet side even in the case of differently heated pipes of the steam generator which are connected in parallel on the flow medium side.

For this design of steam generator, in order to obtain a particularly low load through thermally-related stresses particularly in relation to the manufacturing and assembly costs kept particularly low in relation to the distribution of the flow medium on the water side and/or the steam side, the continuous heating panel of the evaporator of the steam generator can be designed as U-shape comprising a plurality of pipes of a steam generator which are connected in parallel to each other for through-flow of the flow medium, which each feature an almost vertically arranged down pipe section through which the flow medium can flow in a downwards direction and connected downstream from this on the flow medium side an almost vertically arranged riser pipe through which the flow medium can flow in an upwards direction. As has been shown, with this type of design, a pressure contribution through the geodetical pressure of the water column in the down pipe of the specific pipe of the steam generator can be utilized in a way that favors and promotes flow when the continuous heating panel is cross-flown.

However, such a design could basically promote the occurrence of flow instabilities on operating the continuous heating panel of the evaporator which could bring about operational disadvantages. Although supplying the pipes of the steam generator forming the continuous heating panel with a relatively low mass flow rate density and the relatively low frictional pressure loss associated with these allows the natural circulation characteristics of the flow in the pipe of the steam generator to be obtained, which has a stabilizing effect on the flow. Nevertheless, it is also desirable especially in the case of such a design with a pipe section which can be cross-flown downwards to contribute, to a particular extent to stabilizing the flow ratios when the continuous heating panel of an evaporator is operated.

SUMMARY OF THE INVENTION

Therefore, it is the object of the invention to specify a method for operating a steam generator of the type stated above in which in a relatively simple manner an especially high level of flow stability can be achieved during operation of the continuous heating panel of the evaporator. In addition a steam generator of the type stated above which is particularly suitable for carrying out the method should be specified.

With regard to the method, this object of the invention is achieved by the flow medium being supplied to the continuous heating panel of the evaporator in such a way that in the down pipe section of the relevant steam generator pipe it has a flow velocity which is higher than a pre-specified minimum flow velocity.

Thus, the invention takes as its starting point the consideration that a particularly high flow stability and thereby an exceedingly high degree of operational safety for the said steam generator can be obtained by explicitly suppressing possible causes for flow instabilities occurring. As has been shown, an occurrence of steam bubbles in the down pipe of the specific steam generator pipe can be considered to be one of these possible causes. However, if steam bubbles should be formed in a part of the down pipe, these could rise in the water column in the down pipe and therefore move against the direction of flow of the flow medium. The explicit suppression of such a movement of possibly occurring steam bubbles flowing against the direction of flow of the flow medium should by means of a suitable specification of the operating parameters ensure a forced entrainment of the steam bubbles in the actual direction of flow of the flow medium. This can be achieved by supplying the continuous heating panel of the evaporator with a flow medium in a suitable way in which case a sufficiently high flow velocity of the flow medium in the pipes of the steam generator brings about the desired entrainment effect on the steam bubbles possibly already there or any bubbles formed.

In this case the flow velocity of the flow medium in the part of the down pipe of the specific pipe of the steam generator is advantageously set in such a way that in the permissible operating area, an entrainment of possibly occurring steam bubbles is guaranteed in any event. For this purpose, the flow velocity required for the entrainment of the steam bubbles is advantageously predefined as the minimum velocity for the flow velocity of the flow medium in the part of the down pipe of the specific pipe of the steam generator and possibly increased by means of a suitably selected margin of safety.

A sufficiently high flow velocity of the flow medium in the part of the down pipe of the specific pipe of the steam generator can be set in a particularly easy way by supplying the flow medium to the part of the down pipe of the specific pipe of the steam generator in the partially evaporated state and/or with a certain minimum enthalpy. For this purpose, the flow medium is advantageously partially pre-evaporated before entering the continuous heating panel of the evaporator in such a way that, on entering the continuous heating panel of the evaporator, it has a steam content and/or an enthalpy of more than one predefined minimum steam content or a predefined minimum enthalpy.

As regards the steam generator, said object of the invention is achieved in that the continuous heating panel of the evaporator is connected upstream of the further continuous heating panel of the evaporator on the flow medium side.

This means that the evaporator system of the steam generator is embodied as a multi-stage design in which case the further continuous heating panel of the evaporator is provided as a pre-evaporator in order to suitably condition the flow medium before it enters the actual continuous heating panel of the evaporator. By contrast, the actual continuous heating panel of the evaporator is used as a kind of second evaporator stage in order to complete the evaporation of the flow medium.

Expediently the further continuous heating panel of the evaporator is in itself also arranged for a self-stabilizing flow behavior by means of the consistent utilization of the natural circulation characteristics in the specific pipes of the steam generator. For this purpose, the further continuous heating panel of the evaporator advantageously comprises a plurality of pipes of a steam generator which are connected in parallel to each other and said pipes are constructed in such a way that they cross a flow medium. Expediently the continuous heating panel of the evaporator is arranged in such a way that one pipe of the steam generator which is hotter than the other pipe of the steam generator of the same continuous heating panel of the evaporator has a flow medium rate which is higher than that of the other pipe of the steam generator. It also relates to a steam generator for carrying out said method.

In order to reliably ensure that the desired effect of a consistent entrainment of steam bubbles possibly occurring in the part of a down pipe of a pipe of the steam generator of the continuous heating panel of the evaporator, the further continuous heating panel of the evaporator is expediently dimensioned in such a way that during operation, the flow medium flowing into the continuous heating panel of the downstream evaporator has a flow velocity which is higher than a minimum flow velocity required for the entrainment of the steam bubbles.

While the continuous heating panel of the evaporator of the steam generator is formed from the said u-shaped pipes of the steam generator, the further continuous heating panel of the evaporator is formed, in order to avoid obstructions there by possibly occurring steam bubbles and expediently, by steam generator pipes so that the flow medium can flow from below in an upward direction. The further continuous heating panel of the evaporator is in particular thereby exclusively formed from riser pipe parts.

With this type of design of the steam generator, the further continuous heating panel of the evaporator is, expediently, provided with a plurality of outlet accumulators arranged above the heating gas for the flow medium. For a concept kept especially simple as regards the outlet-side homogenizing of the flow medium flowing from the further continuous heating panel of the evaporator, the outlet accumulator connected downstream on the flow medium side is advantageously aligned with its longitudinal axis essentially parallel to the direction of a heating gas.

With this type of design, the characteristic of the further continuous heating panel of the evaporator provided in any event, namely a self-stabilizing circulation characteristic, is explicitly used for the simplification of the distribution. Precisely because of the self-stabilizing circulation characteristic, it is possible for the pipes of a steam generator connected in series and as a result heated differently, namely, also seen in the direction of a heating gas, to each case join a common outlet accumulator on the outlet side under more or less the same steam conditions. The flow medium flowing from the pipes of the steam generator is mixed in this unit and provided for forwarding to a subsequent heating panel system without adversely affecting the homogenizing obtained during the mixing process. Therefore, a special, relatively costly distribution system connected downstream of the continuous heating panel is not required.

For a design kept relatively simple the further continuous heating panel of the evaporator comprises, preferably in the form of a bundle of pipes, a plurality of pipe sets connected in series seen in the direction of a heating gas, each one of which is formed from a plurality of pipes of a steam generator connected next to one another in the direction of a heating gas. In essence, the subsequent distribution of the flow medium to the further continuous heating panel of the evaporator by saving on a costly distribution system can be embodied particularly simply while in the further advantageous embodiment of the further continuous heating panel of the evaporator a corresponding plurality of outlet accumulators aligned with their longitudinal axis parallel to the direction of a heating gas are allocated to a plurality of pipes of a steam generator in each pipe set. Therefore, in each case a pipe of the steam generator of each pipe set now joins each outlet accumulator. The outlet accumulators are advantageously arranged above the heating gas channel.

Because of the essentially u-shaped design of the pipes of the steam generator forming the continuous heating panel of the evaporator, their inflow area is in the top area or above the heating gas channel. In essence, both the consistent utilization of the outlet accumulators allocated to the further continuous heating panel of the evaporator and said accumulators arranged above the heating gas channel which are in each case aligned with their longitudinal direction parallel to the direction of flow of a heating gas, in particular, make possible a cost-effective interconnection of the continuous heating panel of the evaporator to the further continuous heating panel of the evaporator by integrating the outlet accumulator or each outlet accumulator of the further continuous heating panel of the evaporator in an advantageous embodiment with a downstream continuous heating panel of the evaporator allocated to the inlet accumulator in each case in a constructional unit on the flow medium side.

Such an arrangement makes possible direct overflowing of the flow medium emerging from the further continuous heating panel of the evaporator in the pipes of the steam generator connected downstream on the flow medium side of the continuous heating panel of the evaporator said in the first instance. In this arrangement, transfer of the flow medium flowing from the further continuous heating panel of the evaporator into the continuous heating panel of the evaporator is possible almost without adversely affecting the homogenization achieved by mixing in the outlet collector of the further continuous heating panel. Costly distributor or connection lines between the outlet accumulator of the further continuous heating panel and the inlet accumulator of the continuous heating panel as well as the allocated mixing and distribution elements can thus be dispensed with and generally line routing is relatively simple.

In a further advantageous embodiment, the pipes of the steam generator of the continuous heating panel of the evaporator are connected on the inlet side to a common plane aligned parallel to the longitudinal direction of the accumulator units to which the inlet accumulators are connected in each case. This type of arrangement ensures that the partially evaporated flow medium to be fed to the continuous heating panel of the evaporator, starting from the part used as the outlet accumulator for the further continuous heating panel of the evaporator of the integrated unit, first of all collides with the bottom of the part of the constructional unit used as the inlet accumulator for the continuous heating panel of the evaporator and is once again subjected to turbulence there and subsequently, with almost the same two-phase components, flows away into the pipes of the steam generator of the continuous heating panel of the evaporator connected to the specific inlet accumulator. As a result of the symmetrical arrangement of the outlet points from the relevant inlet accumulator viewed in the direction of flow of the accumulator units there is particularly homogeneous feed of flow medium to the continuous heating panel.

Expediently, the steam generator is used as a waste-heat steam generator of a gas and steam turbine plant. For this purpose, the steam generator is advantageously connected downstream of the heating gas side of a gas turbine. With this circuit, an additional firing in order to increase the heating gas temperature can expediently be arranged behind the gas turbine.

The advantages obtained with the invention are to be found especially in the fact that the at least partial pre-evaporation of the flow medium now provided before it flows into the continuous heating panel made up essentially of u-shaped pipes of the steam generator, means that a desired steam content and/or a desired enthalpy of the flow medium can be set according to predefined criteria. By suitably selecting the steam content and/or the enthalpy of the flow medium flowing into the continuous heating panel above a predefined minimum steam content and/or a predefined minimum enthalpy, a sufficient flow velocity of the flow medium in the part of the down pipe of the specific pipe of the steam generator of the continuous heating panel can be ensured. The flow velocity of a water-steam mixture is, in particular, in the case of an equal mass through-flow the higher, the greater the steam content, and in this way forms the specific volume of the mixture.

In this case the flow velocity of the water-steam mixture can in particular be set high enough for possible steam bubbles occurring in the part of the down pipe of the specific pipe of the steam generator to reliably be entrained and can be transported in the part of the riser pipe connected downstream of the specific part of the down pipe. Even in the case of the u-shaped embodiment of the pipes of the steam generator of the continuous heating panel of the evaporator, a movement of the steam bubbles away from the flow direction of the flow medium is securely prevented so that a particularly high flow stability and as a result a particularly high operational safety for the steam generator with a continuous heating panel of the evaporator designed in this way is guaranteed.

BRIEF DESCRIPTION OF THE DRAWINGS

An embodiment of the invention is explained in greater detail with reference to the accompanying drawings. They are as follows.

In all the figures, the same reference symbols are allocated to the same parts.

DETAILED DESCRIPTION OF THE INVENTION

Figure 1:
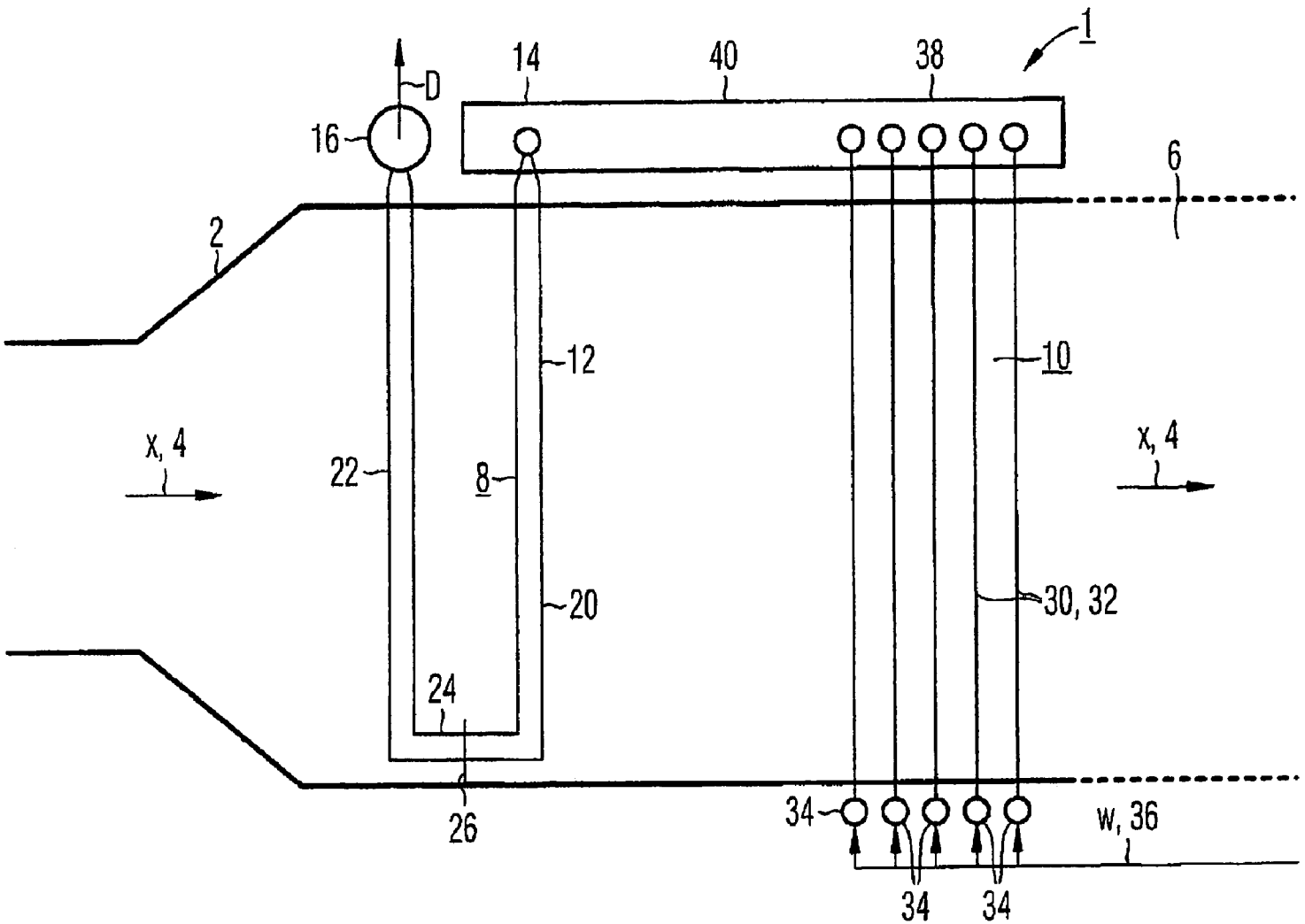
FIG. 1 a simplified, longitudinal sectional view of the evaporator section of a horizontal steam generator, FIG. 2 a sectional view from above of the steam generator according to FIG. 1, FIG. 3 sectional view of the steam generator according to FIG. 1 along the line of cut shown in FIG. 2, FIG. 4 sectional view of the steam generator according to FIG. 1 along the line of cut shown in FIG. 2, and FIG. 5 an enthalpy or mass flow rate diagram of the flow velocity.

The steam generator 1 shown in FIG. 1 with an evaporator section is connected downstream, on the waste gas side as a waste-heat steam generator, of a gas turbine which is not shown in greater detail. The steam generator 1 has an enclosing wall 2 which forms a heating gas channel 6 which can be cross-flown in a more or less horizontal direction of a heating gas x indicated by means of arrows 4 for the waste gas from the gas turbine. Said heating gas channel 6 comprises a plurality—two in the embodiment—of continuous heating panels of the evaporator 8, 10 embodied according to the through-flow principle which are connected in series for the through-flow of a flow medium W, D.

The multi-stage evaporator system formed from the continuous heating panels of the evaporator 8, 10 can be subjected to a non-evaporated flow medium W which evaporates in the case of a single through-flow through the continuous heating panels of the evaporator 8, 10 and, after flowing from the continuous heating panel of the evaporator 8, is discharged as steam D and usually supplied to the superheater panels for superheating. The evaporator system formed from the continuous heating panels of the evaporator 8, 10 is arranged in the water-steam cycle of a steam turbine not shown in greater detail. In addition to this evaporator system, a plurality of other heating panels are arranged in the water-steam cycle of the steam turbine (not shown in greater detail in FIG. 1) in the case of which these may be, for example, a superheater, medium-pressure evaporator, low-pressure evaporator and/or a preheater.

The continuous heating panel of the evaporator 8 of the steam generator 1 comprises a plurality of pipes of a steam generator 12 as a bundle of pipes which are connected in parallel to each other. Said pipes are constructed in such a way that they cross a flow medium W. Thus, a plurality of pipes of a steam generator 12 are seen in each case with the formation of a so-called pipe set in the direction of a heating gas x which is arranged side-by-side so that only one of the pipes of the steam generator 12 of a pipe set is arranged side-by-side in such a way as can be seen in FIG. 1. On the flow medium side, an inlet accumulator 14 connected upstream in each case and a common outlet accumulator 16 connected downstream in each case are allocated to the pipes of the steam generator 12 which are arranged side-by-side.

The continuous heating panel of the evaporator 8 is embodied in such a way that it is suitable for supplying the pipes of the steam generator 12 with a relatively low mass flow rate density in which case the pipes of the steam generator 12 have natural circulation characteristics. In the case of these natural circulation characteristics, the continuous heating panel of the evaporator is arranged in such a way that one pipe of the steam generator 12 which is hotter than the other pipe of the steam generator 12 of the same continuous heating panel of the evaporator 8 has a flow medium W rate which is higher than that of the other pipe of the steam generator. In order to ensure this, in particular, with simple constructional means in a particularly reliable way, the continuous heating panel of the evaporator 8 comprises two segments which are connected in series on the flow medium side. In the first segment, each pipe of the steam generator 12 of the continuous heating panel 8 is provided with the part of a more or less vertical down pipe 20 which can be cross-flown by the flow medium W in a downward direction. In a second segment, each pipe of the steam generator 12 is provided with the part of a riser pipe 22 connected down-stream with respect to the part of the down pipe 20 on the flow medium side and which is more or less vertical and can be cross-flown by the flow medium W in an upward direction.

In this case the part of the riser pipe 22 is connected to the part of the down pipe 20 allocated to it via a part of the overflow 24.

Each pipe of the steam generator 12 of the continuous heating panel of the evaporator 8 has an almost u-shaped form (as can be seen in FIG. 1) in which case the bend of the U is formed by the part of the down pipe 20 and the part of the riser pipe 22 and the connection elbow by the part of the overflow 24. In the case of such a pipe of the steam generator 12 embodied in such a way, the geodetical pressure generates the pressure contribution of the flow medium W in the area of part of the down pipe 20—by contrast with the area of the part of the riser pipe 22—thus, a flow-promoting and not a flow-inhibiting pressure contribution. In other words: The water column of the non-evaporated flow medium W in the part of the down pipe 20 still carries on "thrusting forward" the cross-flow of the specific pipe of the steam generator 12 instead of preventing this from happening. This means that the pipe of the steam generator 12 all in all has a relatively low loss in pressure.

In the case of a more or less u-shaped design, each pipe of the vertical steam generator 12 is in each case in the inlet area of its part of the down pipe 20 and the outlet area of its part of the riser pipe 22 suspended from or fastened to the top of the heating gas channel 6. Seen from a point of view in space, the bottom ends of the specific part of the down pipe 20 and the specific part of the riser pipe 22 which are interconnected by means of their part of an overflow 24 are, on the other hand, not fastened directly in space to the heating gas channel 6. Therefore, extensions of lengths of these segments of the pipes of the steam generator 12 can be tolerated without a risk of being damaged, in which case the specific part of the overflow 24 acts as an extension elbow. This arrangement of the pipes of the steam generator 12 is, as a result, particularly flexible and, with respect to the thermal voltages, is also insensitive to the differential expansions occurring.

However, in the case of a horizontal steam generator 1 and by using the continuous heating panel of the evaporator 8 with, in essence, u-shaped pipes of the steam generator 12, steam bubbles in general still occur in the part of the down pipe 20 of a steam generator 12. However, it is possible that these steam bubbles could rise against the direction of flow of the flow medium W in the specific part of the down pipe 20 and, therefore, adversely affect the stability of the flow and also the reliable operation of the steam generator 1. In order to exclude this in a reliable way, the steam generator 1 is embodied to supply the continuous heating panel of the evaporator 8 with a flow medium W which has already been partially evaporated.

For this purpose, the flow medium D, W of the continuous heating panel of the evaporator 8 is supplied in such a way that the flow medium D, W in the part of the down pipe 20 of the specific pipe of the steam generator 12 has a flow velocity which is higher than a minimum flow velocity predefined in the down pipe. On the other hand, this is again measured in such a way that on the basis of the sufficiently high flow velocity of the flow medium D, W in the part of the down pipe 20, the steam bubbles occurring there are reliably entrained in the direction of flow of the flow medium D, W and are transported via the specific part of the overflow 24 to the part of the riser pipe 22 connected downstream in each case. For this purpose, the adherence to a sufficiently high flow velocity of the flow medium D, W in the parts of the down pipe 20 of the pipes of the steam generator 12 is guaranteed by means of the fact that the supply of the flow medium D, W to the continuous heating panel of the evaporator 8 is, for this purpose, provided with a sufficiently high steam content and/or with a sufficiently high enthalpy.

Therefore, in order to make possible the supply of the flow medium D, W with suitable parameters in the already partially evaporated condition, the continuous heating panel of the evaporator 8 of the steam generator 1 is connected upstream on the flow medium side as the further continuous heating panel of the evaporator 10. Therefore, the continuous heating panel of the evaporator 10 is embodied as a pre-evaporator so that the evaporator system is formed by the further continuous heating panel of the evaporator 10 which is connected downstream with respect to the continuous heating panel of the evaporator 8 on the flow medium side. Therefore, the further continuous heating panel of the evaporator 10 provided as a pre-evaporator is then arranged in space in a relatively lower-temperature range of the heating gas channel 6 and, as a result, on the side of the heating gas downstream of the continuous heating panel of the evaporator 8. On the other hand, the continuous heating panel of the evaporator 8 is arranged closer to the inlet area of the heating gas channel 6 for the heating gas flowing from the gas turbine and, as a result, is exposed in operating cases to a relatively high thermal input because of the heating gas.

The further continuous heating panel of the evaporator 10 is for its part also formed by a plurality of pipes of a steam generator 30 which are connected in parallel to each other so that they cross a flow medium W. Therefore, the pipes of the steam generator 30, in essence, are arranged with their longitudinal axis in such a way that they are more or less vertical and are constructed in such a way that they cross a flow medium W from a bottom inlet area to a top outlet area, thus from the bottom to the top. In order to also guarantee a particularly high stability of the cross-flow for the further continuous heating panel of the evaporator 10 as a self-stabilizing action, the continuous heating panel of the evaporator 10 is also arranged in such a way that one pipe of the steam generator 30 which is hotter than the other pipe of the steam generator 30 of the same continuous heating panel of the evaporator has a flow medium W rate which is higher than that of the other pipe of the steam generator 30.

In order to guarantee, according to the concept envisaged for the evaporator system formed by the continuous heating panel of the evaporator 8 and by the further continuous heating panel of the evaporator 10 which is connected upstream with respect to this, namely the embodiment which on the inlet side, supply the continuous heating panel of the evaporator 8 with a partially pre-evaporated flow medium D, W which has a sufficiently high steam content and/or a sufficiently high enthalpy, the further continuous heating panel of the evaporator 10 is suitably dimensioned. In this case, a suitable material selection and a suitable dimensioning of the pipes of the steam generator 30 must in particular be considered comparatively to each other and possibly also varying from each other, but a suitable positioning of the pipes of the steam generator 30 must also be considered. Specifically with a view to these parameters, the further continuous heating panel of the evaporator 10 is dimensioned in such a way that in operating cases the flow medium D, W flowing into the downstream continuous heating panel of the evaporator 8 has a flow velocity which is higher than a minimum flow velocity required for the entrainment of the steam bubbles occurring in the respective parts of the down pipe 20.

As has been shown, the high operational safety aimed at in the embodiment can, in essence, be achieved to a large extent, by equally distributing the heat absorption in operating cases on the continuous heating panel of the evaporator 8 and on the further continuous heating panel of the evaporator 10. The continuous heating panels of the evaporator 8, 10 and the pipes of the steam generator 12, 30 forming the said continuous heating panels of the evaporator are, as a result, dimensioned in such a way in the embodiment that in operating cases the overall thermal input into the pipes of the steam generator 12 forming the continuous heating panel of the evaporator 8 more or less conforms to the thermal input into the pipes of the steam generator 30 forming the further continuous heating panel of the evaporator 10. With due regard to the resulting mass flow rates, the further continuous heating panel of the evaporator 10 therefore has a suitably selected plurality of pipes of a steam generator 30 with a view to a plurality of pipes of a steam generator 12 of the continuous heating panel 8 connected downstream on the flow medium side.

The pipes of the steam generator forming the further continuous heating panel of the evaporator 10 are embodied for a cross-flow of the flow medium W from the bottom to the top. In this case, the further continuous heating panel of the evaporator 10 comprises as a bundle of pipes, a plurality of pipe sets 32 seen in the direction of a heating gas x, and arranged side-by-side, each one of which is formed from a plurality of pipes of a steam generator 30 seen in the direction of a heating gas x arranged side-by-side and of which only one pipe of the steam generator 30 can be seen in FIG. 1. Thus, one common inlet accumulator 34 is connected upstream of the pipes of the steam generator 30 of each pipe set 32, said inlet accumulator 34, in essence, being aligned with its longitudinal axis vertical to the direction of a heating gas x. As a result, the inlet accumulators 34 are connected to a water supply system 36 only shown diagrammatically in FIG. 1 which can comprise a distribution system for the tailor-made distribution of the inflow of the flow medium W into the inlet accumulator 34.

On the outlet side and, therefore, in an area above the heating gas channel 6, the pipes of the steam generator 30 forming the further continuous heating panel of the evaporator 10 in each case join a plurality of allocated outlet accumulators 38. In essence, each one of the outlet accumulators 38 arranged parallel and side-by-side to each other, of which only one can be seen in FIG. 1, is aligned with its longitudinal axis, in essence, parallel to the direction of a heating gas x. In this case, a plurality of outlet accumulators 38 is adapted to a plurality of pipes of a steam generator 30 in each pipe set 32.

An inlet accumulator 14 is allocated to each outlet accumulator 38 of the continuous heating panel of the evaporator 8 connected downstream to the further continuous heating panel of the evaporator 10 on the flow medium side. On the basis of the u-shaped embodiment of the continuous heating panel of the evaporator 8, the specific inlet accumulator 14 is arranged, in the same way as the specific outlet accumulator 38, above the heating gas channel 6. The continuous heating panel of the evaporator 8 can then be connected in series to the further continuous heating panel of the evaporator 10 in a particularly easy way by integrating each outlet accumulator 38 in the allocated inlet accumulator 14 in a constructional unit 40 in each case. By means of the structural or constructional unit 40, a direct overflow of the flow medium W of the further continuous heating panel of the evaporator 10 is allowed in the continuous heating panel of the evaporator 8 without a relatively expensive distribution or connection system being necessary.

Figure 2:
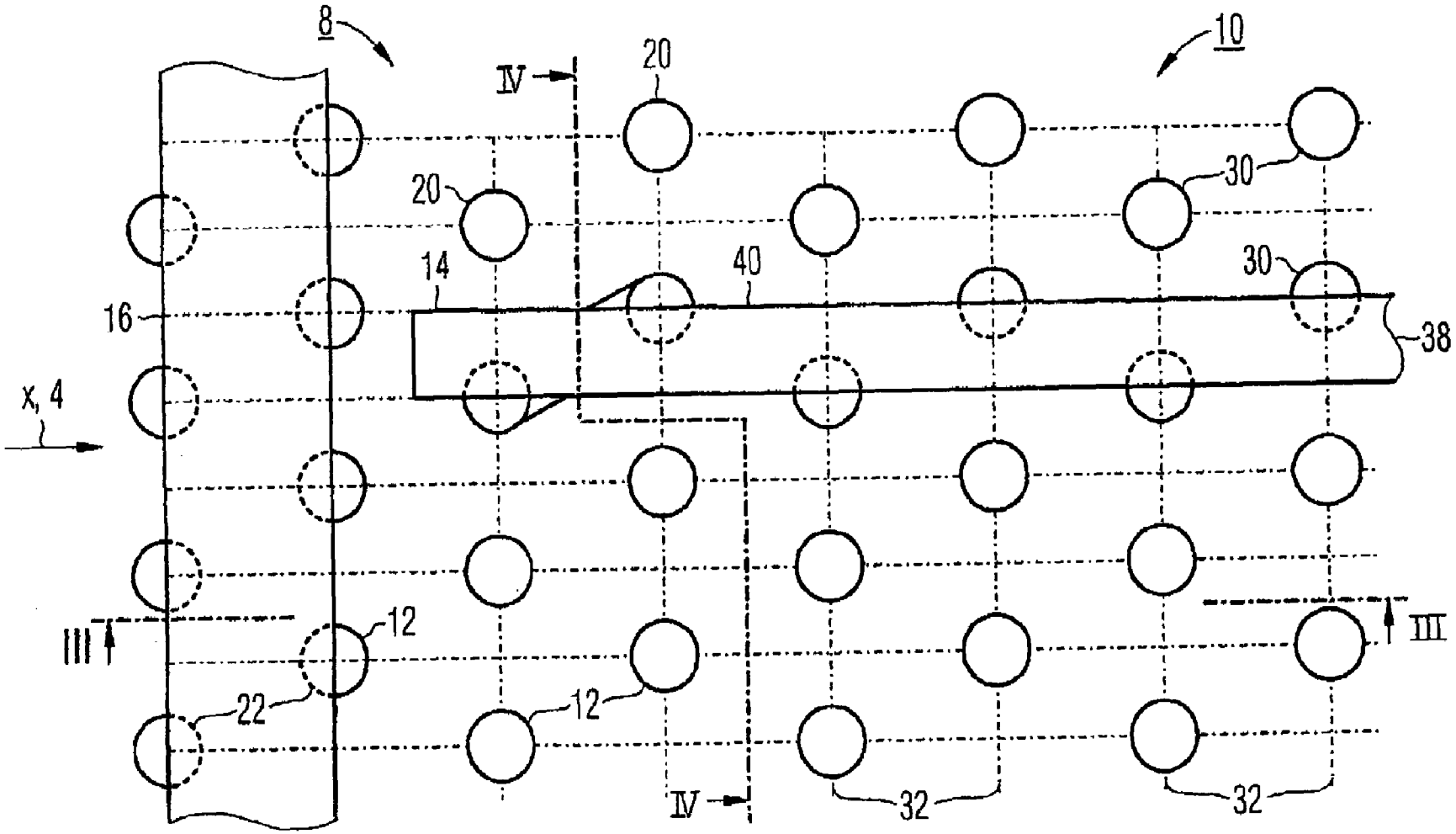

As is shown in the overhead cross-sectional view of FIG. 2, the pipes of the steam generator 30 in each case of two neighboring pipe sets 32 seen in a vertical direction of a heating gas x are arranged in a staggered way, so that with regard to the arrangement of the pipes of a steam generator 30, a rhombic basic pattern is, in essence, obtained as a result. In the case of this arrangement, the outlet accumulators 38, of which only one is shown in FIG. 2, are positioned in such a way that one pipe of the steam generator 30 from each pipe set 32 joins each outlet accumulator 38 in each case. In this case, it can also be identified that each outlet accumulator 38 with an allocated inlet accumulator 14 for the continuous heating panel of the evaporator 8 connected downstream of the further continuous heating panel of the evaporator 10, is integrated in a constructional unit 40.

It can, in addition, be taken from FIG. 2 that the pipes of the steam generator 12 forming the continuous heating panel of the evaporator 8 also form a plurality of pipe sets seen lying behind one another in the direction of a heating gas x, in which case the first two pipe sets seen in the direction of a heating gas x are formed from the parts of the riser pipe 22 of the pipes of the steam generator 12 which on the outlet side in each case join the outlet accumulator 16 for the evaporated flow medium D. The next two pipe sets seen in the direction of a heating gas x are formed, on the other hand, from the parts of the down pipe 20 of the pipes of the steam generator 12 which on the inlet side are connected to an allocated inlet accumulator 14 in each case.

Figure 3:
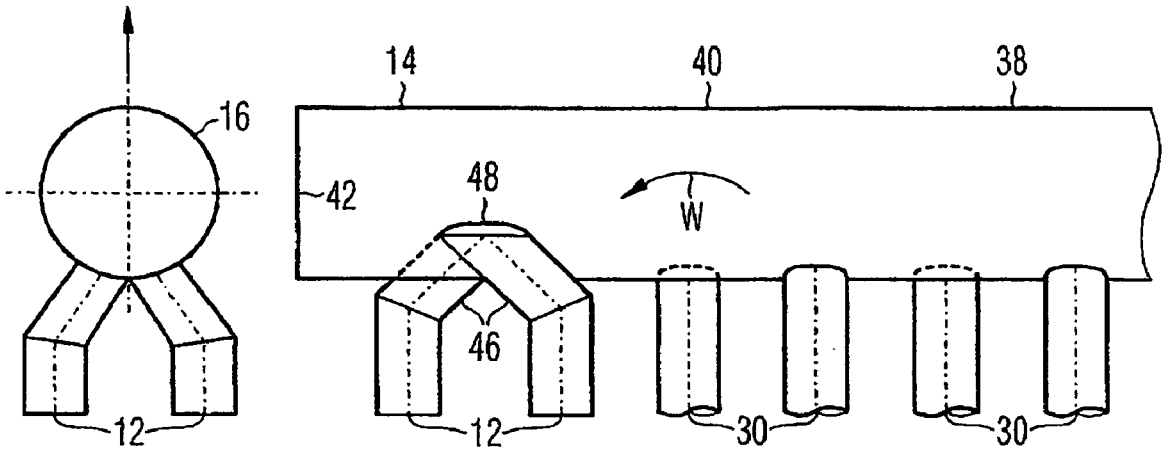

FIG. 3 shows in a sectional side view, the inlet area of the pipes of the steam generator 12 and the outlet area of the pipes of the steam generator 30 in the allocated constructional unit 40 in each case, which comprises, on the one hand, the outlet accumulator 38 for a plurality of pipes of a steam generator 30 forming the further continuous heating panel of the evaporator 10 and, on the other hand, includes the inlet accumulator 14 for two of the pipes of a steam generator 12 forming the continuous heating panel of the evaporator 8 in each case. From this view it is in particular clear that a flow medium D, W flowing from the pipes of the steam generator 30 and entering the outlet accumulator 38 can overflow directly into the inlet accumulator 14 allocated to the continuous heating panel of the evaporator 8. When the flow medium D, W overflows, this then first of all collides with a base plate 42 of the constructional unit 40 comprising the inlet accumulator 14. As a result of this collision there is a turbulence and, in particular, a thorough mixing of the flow medium D, W, before this passes over from the inlet accumulator 14 into the parts of the down pipe 20 of the allocated pipes of a steam generator 12.

As can also still clearly be seen in the view according to FIG. 3, the part of the constructional unit 40 on the end side embodied as the inlet accumulator 14 for the pipes of a steam generator 12 is designed in such a way that the flow medium W flows into the pipes of a steam generator 12 for all the pipes of a steam generator 12 from a single plane vertical to the longitudinal direction of the constructional unit 40. In order to make this possible also for two pipes of a steam generator 12 which, with regard to their actual positioning in space, to which two different pipe sets arranged behind one another seen in the direction of a heating gas x must be allocated, a part of the overflow 46 is, in each case, allocated to each pipe of a steam generator 12. Each part of the overflow 46 then slopes in the direction of a heating gas x and connects the top area of the pipe of an allocated steam generator 12 to the specific outlet opening 48 of the inlet accumulator 14 in each case. By means of this arrangement, all the outlet openings 48 of the inlet accumulator 14 can be positioned in a common plane vertical to the cylinder axis of the constructional unit 40 so that already on the basis of the symmetrical arrangement of the outlet openings 48, in relation to the flow path of the flow medium D, W, an equal distribution of the flow medium D, W flowing into the pipes of a steam generator 12 is guaranteed.

Figure 4:
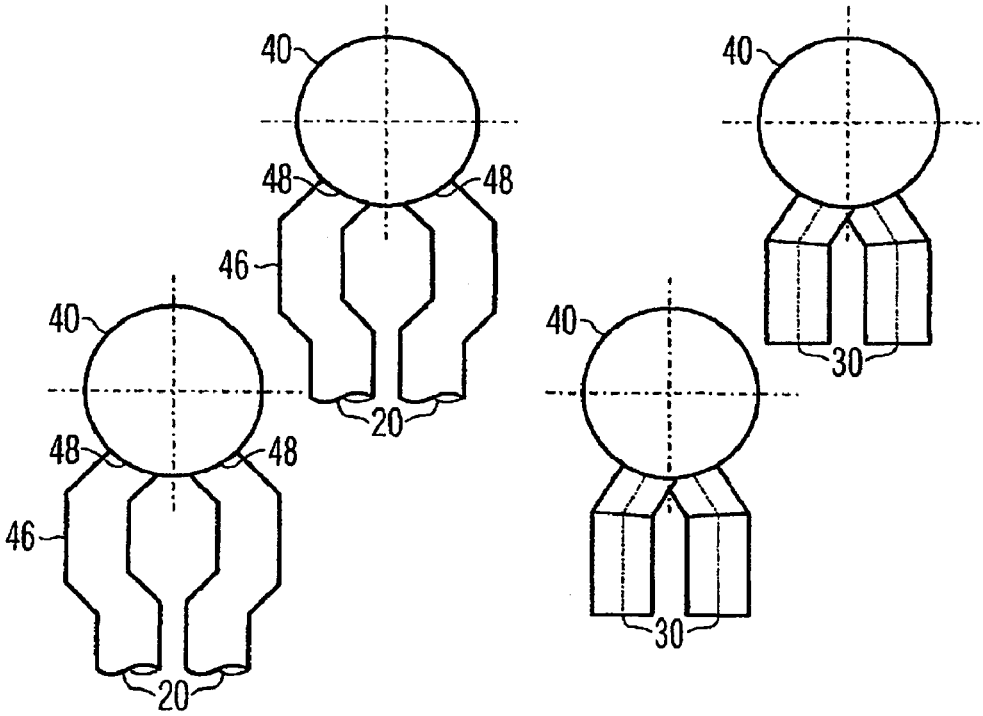

In order to further explain the pipe layouts in the area of their inlets or outlets in the constructional unit 40 or from the constructional unit 40, a plurality of such constructional units 40 is shown in FIG. 4 as a front view, in which case the line of cut designated with IV in FIG. 2 is used as the starting basis. In this case, it can also be identified that the two constructional units 40 shown on the left in FIG. 4 which in the area of their end, embodied as the inlet accumulator 14 for the downstream pipes of a steam generator 12 are in each case connected via the parts of the overflow 46 to the parts of the down pipe 20 connected downstream of the pipes of a steam generator 12.

In comparison with this, the two constructional units 40 shown on the right in FIG. 4, in each case shown in the vicinity of their front area embodied as the outlet accumulator 38 for the pipes of a steam generator 30 of the further continuous heating panel of the evaporator 10 are shown. In this case, it can be taken from the drawing that the pipes of a steam generator 30 joining the pipe sets 32 lying behind one another in the constructional unit 40 in each case pass into the constructional unit 40 at simple angles.

The steam generator 1 according to FIG. 1 and with the special embodiments according to FIGS. 2 to 4 is embodied for a safe operation of the continuous heating panel of the evaporator 8 in particular. In this case, when operating the steam generator 1 it is, in essence, ensured that the flow medium D, W of the continuous heating panel of the evaporator 8 which is u-shaped is supplied in such a way that the flow velocity thereof is higher than a minimum flow velocity predefined in the down pipe. This results in the fact that the steam bubbles occurring in the parts of the down pipe 20 of the pipes of a steam generator forming the continuous heating panel 8 are entrained and carried into the part of the riser pipe 22 connected downstream in each case. In order to ensure a sufficiently high flow velocity of the flow medium D, W flowing into the continuous heating panel of the evaporator 8, the continuous heating panel of the evaporator 8 is supplied by using the further continuous heating panel of the evaporator 10 connected upstream to it in such a way that the flow medium D, W flowing into the continuous heating panel of the evaporator 8 has a steam content or an enthalpy which is higher than that of a predefinable minimum steam content or higher than a predefinable minimum enthalpy. In order to adhere to the operating parameters which are suitable for this, the continuous heating panels of the evaporator 8, 10 are embodied or dimensioned in such a way that in all the operating points, the steam content or the enthalpy of the flow medium D, W on entering the continuous heating panel of the evaporator 8 is above the suitably predefined characteristics as shown, for example, in FIGS. 5*a*, 5*b*.

Figure 5A:
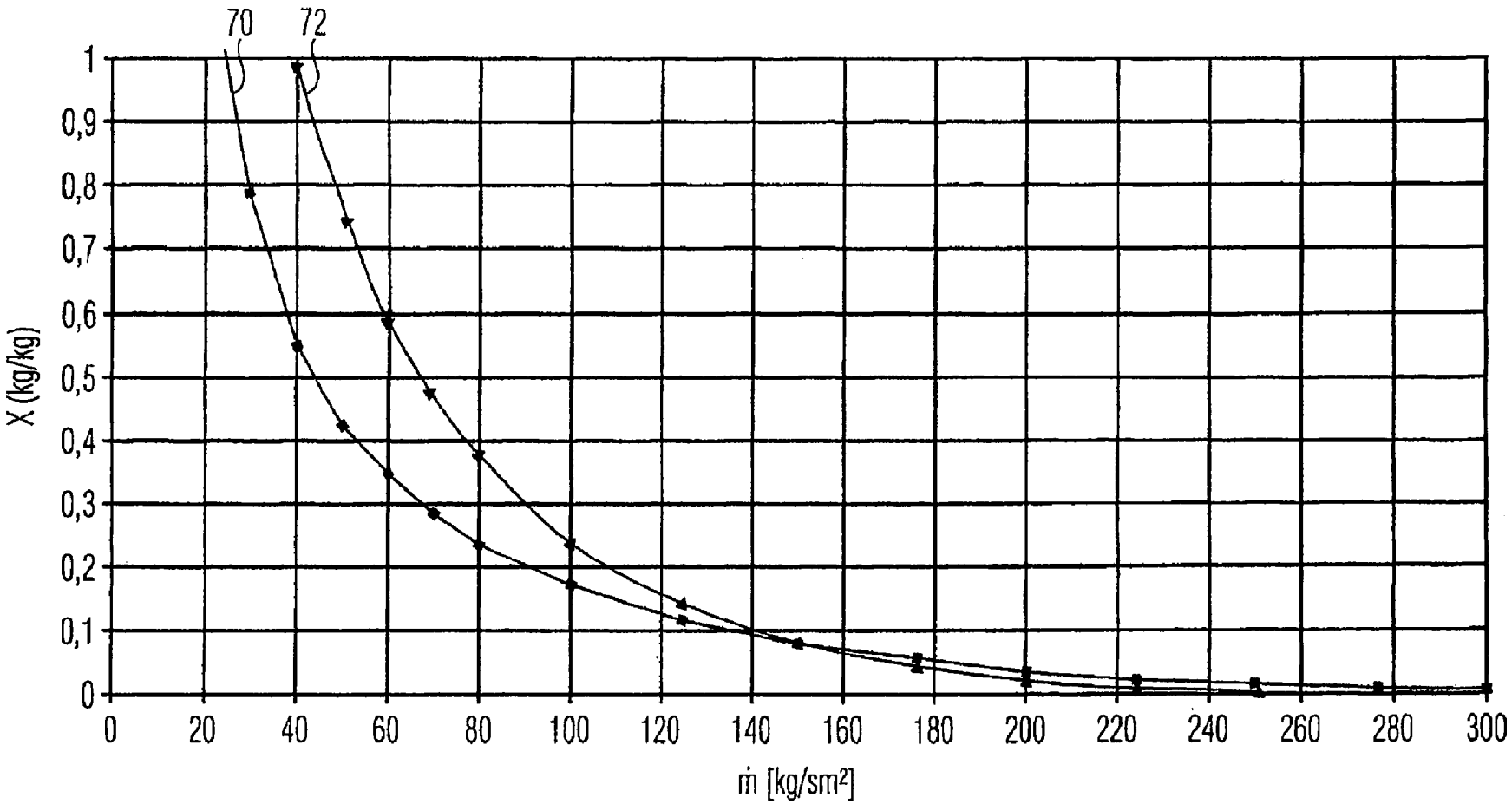
Figure 5B:
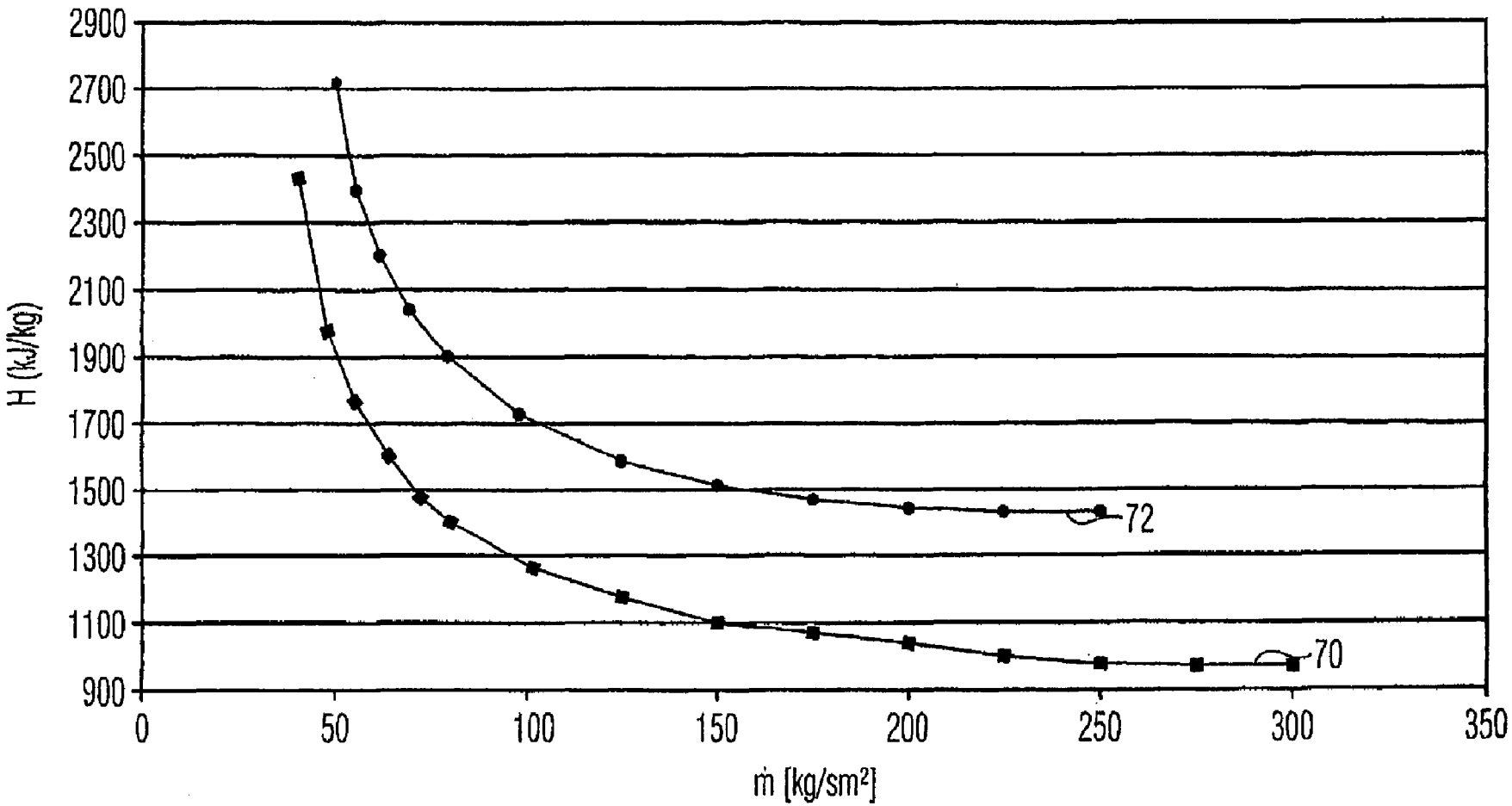

FIGS. 5*a*, 5*b* show as a family of curves with the operating pressure as the family of parameters, the functional dependency of the minimum steam content $X_{min}$ to be set or the minimum enthalpy $H_{min}$ to be set as a function of the embodiment according to the selected mass flow rate density m. In this case, curve 70 represents the criterion of the embodiment for an operating pressure of p=25 bar in each case, whereas curve 72 is provided for an operating pressure of p=100 bar in each case.

Therefore, it is possible to identify from this family of curves that, for example, during a part load operation in the case of an embodiment of the mass flow rate density m of 100 kg/m$^2$s and a provided operating pressure of p=100 bar, it should be ensured that the steam content $X_{min}$ in the flow medium W that flows into the continuous heating panel 8 should have a value of at least 25%, but preferably approximately 30%. In an alternative view of this criterion of the embodiment it can also be provided that the enthalpy of the flow medium W flowing into the continuous heating panel 8 should, in the case of the said operating conditions, at least have a value of H=1750 kJ/kg. The further continuous heating panel 10 provided for the adherence of these conditions according to the embodiment, is adapted to these boundary conditions with regard to its dimensioning, therefore, for example, with regard to the nature, number and embodiment of the pipes of the steam generator 30 forming it, with due consideration of the heat evolved present according to the embodiment in the area provided for its spatial positioning within the heating gas channel 6.

The invention claimed is:

1. A method for operating a steam generator, comprising:

arranging a continuous heating panel of an evaporator in a heating gas channel that is cross-flown in a substantially horizontal direction of a heating gas, comprising;

a plurality of pipes of a steam generator are connected in parallel to each other and are constructed such that they cross a flow medium and are provided with a portion of a substantially vertical down pipe that can be cross-flown by a flow medium in a downward direction and with the part of a riser pipe connected downstream with respect to the down pipe on a flow medium side and is substantially vertical and can be cross-flown by the flow medium in an upward direction and the continuous heating panel of the evaporator is arranged such that one pipe of the steam generator that is hotter than an other pipe of the steam generator of the same continuous heating panel of the evaporator has a flow medium rate that is higher than that of the other pipe of the steam generator, wherein the flow medium of the continuous heating panel of the evaporator is supplied in such a way that the flow medium in the part of the down pipe of the specific pipe of the steam generator has a flow velocity which is higher than a minimum flow velocity predefined in the down pipe.

2. The method according to claim 1, wherein the flow velocity required for the entrainment of steam bubbles generated in the relevant part of the down pipe is specified.

3. The method according to claim 1, wherein the flow medium is advantageously partially pre-evaporated before entering the continuous heating panel of the evaporator such that on entering the continuous heating panel of the evaporator the flow medium has a steam content or an enthalpy of more than one predefined minimum steam content or a predefined minimum enthalpy.

4. The method according to claim 1, wherein the flow medium is advantageously partially pre-evaporated before entering the continuous heating panel of the evaporator such that on entering the continuous heating panel of the evaporator the flow medium has a steam content and an enthalpy of more than one predefined minimum steam content or a predefined minimum enthalpy.

5. A steam generator having a continuous heating panel of an evaporator that is arranged in a heating gas channel and is cross-flown in a substantially horizontal direction of a heating gas, comprising:

a plurality of pipes of the continuous heating panel that are connected in parallel to each other and cross a flow medium and are provided with a portion of a substantially vertical down pipe and is cross-flown by a flow medium in a downward direction;

a corresponding plurality of portions of riser pipes connected with the plurality of pipes, each said portion connected downstream with respect to the respective portion of the down pipe on the flow medium side and substantially vertical and cross-flown by the flow medium in an upward direction in which case the continuous heating panel of the evaporator is arranged in such a way that one pipe of the steam generator that is hotter than the other pipe of the steam generator of the same continuous heating panel of the evaporator has a flow medium rate which is higher than that of the other pipe of the steam generator; and a further continuous heating panel of the evaporator is connected upstream of the continuous heating panel of the evaporator on the flow medium side wherein at least one outlet accumulator of the further continuous heating panel of the evaporator of the pipes of the steam generator connected downstream on the flow medium side is aligned with its longitudinal axis parallel to the direction of the heating gas, and wherein each of said at least one outlet accumulator of the further continuous heating panel of the evaporator is integrated in a constructional unit with an allocated respective inlet accumulator of the continuous heating panel of the evaporator.

6. The steam generator according to claim 5, further comprising a plurality of pipes of a steam generator that are connected in parallel to each other, the pipes of a steam generator are constructed in such a way that they cross a flow medium and that one pipe of the steam generator that is hotter than the other pipe of the steam generator of the further continuous heating panel of the evaporator, shows a flow medium rate which is higher than that of the other pipe of the steam generator.

7. The steam generator according to claim 6, wherein the further continuous heating panel of the evaporator is dimensioned such that in operating cases the flow medium flowing into the downstream continuous heating panel of the evaporator has a flow velocity which is higher than a minimum flow velocity required for the entrainment of steam bubbles.

8. The steam generator according to claim 6, wherein the further continuous heating panel of the evaporator further comprises a plurality of pipe sets connected in series in the direction of a heating gas, each formed from a plurality of pipes of a steam generator connected next to one another in the direction of the heating gas.

9. The steam generator according to claim 8, wherein a plurality of outlet accumulators, whose plurality corresponds with the plurality of pipes of a steam generator in each pipe set is aligned with their longitudinal axis parallel to the direction of the heating gas, and are allocated while one pipe of the steam generator of each pipe set joins each outlet accumulator.

10. The steam generator according to claim 6, wherein the pipes of the steam generator of the continuous heating panel of the evaporator are connected to a common plane aligned vertically to the heating gas direction to which the inlet accumulators are connected in each case.

11. The steam generator according to claim 6, wherein the outlet accumulator is arranged above the heating gas channel.

12. The steam generator according to claim 11, wherein a gas turbine is connected upstream on the side of the heating gas.

* * * * *